United States Patent [19]

Parker, Jr.

[11] Patent Number: 4,860,733

[45] Date of Patent: Aug. 29, 1989

[54] OSCILLATING RECLINING CHAIR

[76] Inventor: Alonzo E. Parker, Jr., P.O. Box 11276, Durham, N.C. 27703

[21] Appl. No.: 240,253

[22] Filed: Sep. 2, 1988

Related U.S. Application Data

[63] Continuation-in-part of Ser. No. 152,075, Feb. 4, 1988, abandoned.

[51] Int. Cl.[4] ..... A61H 1/02

[52] U.S. Cl. ..... 128/25 R; 297/330; 128/33; 128/69

[58] Field of Search ..... 272/144; 128/25 R, 69, 128/73, 74, 48, 49, 70, 33; 297/330, 314, 353

[56] References Cited

U.S. PATENT DOCUMENTS

| | | | |
|---|---|---|---|
| 3,480 | 3/1844 | Halsted | 272/144 |
| 1,602,196 | 10/1926 | Iverson et al. | 128/70 |
| 2,053,852 | 9/1936 | Tracy | 297/330 X |
| 2,179,595 | 11/1939 | McManis | 128/25 R |
| 2,463,602 | 3/1949 | Dehmel | 297/330 |
| 2,548,408 | 4/1951 | Tammen | 272/144 X |
| 2,550,841 | 5/1951 | Martinez | 128/33 |
| 2,770,233 | 11/1956 | Thomas | 297/330 |
| 2,908,917 | 10/1959 | Pinson | 297/330 |
| 2,915,055 | 12/1959 | Matton | 128/33 |
| 3,019,052 | 1/1962 | Zawadzki | 297/260 |
| 3,674,017 | 7/1972 | Stafani | 128/25 R |
| 3,824,991 | 7/1974 | Whitaker | 128/49 X |
| 4,194,499 | 3/1980 | Donnelly | 128/33 X |
| 4,500,062 | 2/1985 | Sandvik | 297/314 X |
| 4,650,247 | 3/1987 | Berg et al. | 297/330 X |
| 4,723,537 | 2/1988 | Parker, Jr. | 128/25 R |
| 4,725,055 | 2/1988 | Skowronski | 272/144 X |

*Primary Examiner*—Richard J. Apley
*Assistant Examiner*—H. Flaxman
*Attorney, Agent, or Firm*—Olive & Olive

[57] ABSTRACT

A passive exercise apparatus includes an oscillating back portion incorporated in a conventional reclining chair. A drive assembly is mounted to a lower back portion. An upper back portion is pivotally connected to the lower back portion. The drive assembly is activated to oscillate the upper back portion when the recliner is in either an upright or an extended position.

6 Claims, 5 Drawing Sheets

OSCILLATING RECLINING CHAIR

This is a continuation-in-part of application Ser. No. 07/152,075, filed Feb. 4, 1988, now abandoned.

BACKGROUND OF THE INVENTION

1. Field of the Invention

The present invention relates generally to a passive exercise device. In particular, the exercise device includes a back portion which imparts an oscillating motion to the upper body while a user is seated. The oscillating back portion can be utilized with a conventional reclining chair.

2. Description of the Related Art

Passive exercising apparatuses have been developed to impart movement to various portions of a user's body. For example, devices have been designed to raise the upper portion of a user's body while the user's lower body remains horizontal. In this manner, the abdominal muscles are flexed. Passive exercise devices are particularly useful for invalids and overweight persons.

Representative prior art believed to be sufficient for an adequate background is next described.

U.S. Pat. No. 3,480 shows an exercise machine for rocking a person while seated in a chair.

U.S. Pat. 1,733,919 discloses a chair which is given a zigzag movement by fastening the chair to a crank shaft which is adapted to rotate.

U.S. Pat. No. 2,550,841 shows a chair seat mounted on a rigid chair frame. The seat oscillates about a vertical axis which appears to pass through the seat. Each of a pair of back sections appear to oscillate about separate axis.

U.S. Pat. No. 3,019,052 describes an automatic rocker and glider which is oscillated by a motor.

U.S. Pat. No. 3,674,017 shows a passive exercising apparatus which moves the torso with respect to the legs, or from a prone to a sitting position.

U.S. Pat. No. 3,886,608 discloses a rocking chair or cradle with a rocking mechanism. An automatic rocking means comprises an electric motor and a crank rotatably driven by a motor.

Applicant's prior U.S. Pat. No. 4,723,537 teaches a passive exercising apparatus comprising a first stationary horizontal platform connected to a second platform forming a lengthwise extension of the first platform and connected thereto for relatively pivotal or rotative movement. A drive mechanism is supported below the second platform to be selectively pivoted up and down or back and forth around its central longitudinal axis so as to vary the type of exercise obtained.

The art continues to seek improvements. It is desirable that a passive exercise apparatus impart an oscillating motion to the upper body when a user is seated. Furthermore, it is also desirable that such an apparatus be capable of a simultaneous rocking motion. It is also desirable that a conventional reclining chair be equipped to both recline and oscillate the upper body as achieved by the present invention.

SUMMARY OF THE INVENTION

The passive exercising apparatus of the invention imparts an oscillating motion to the upper torso of a user. A user is seated in the apparatus just as he or she would sit in a chair. Upon activation of a drive assembly, a back portion of the apparatus oscillates so as to oscillate the upper torso of a user. In an alternative embodiment, the apparatus includes arms and a second drive assembly for simultaneously rocking the apparatus about a horizontal axis.

In a first embodiment, the present invention includes a passive exercise apparatus for oscillating the upper torso of a user. The apparatus includes a seat portion and a back portion. A post is pivotally connected to the seat portion and is fixedly connected to the back portion. A drive assembly on the seat portion is connected to the back portion. Means such as a switch may be utilized to selectively activate the drive assembly to oscillate the back portion.

In a second embodiment, a second drive assembly connected to the seat portion is employed to selectively rock the apparatus. The respective drive assemblies can be operated simultaneously or independently.

In a third embodiment, the apparatus includes an oscillating back portion incorporated in a conventional reclining chair. A drive assembly is mounted on a lower back portion. An upper back portion is pivotally connected to the lower back portion. The drive assembly is activated to oscillate the upper back portion when the recliner is in either an upright or an extended position.

DETAILED DESCRIPTION OF THE PREFERRED EMBODIMENTS

Figure 1:
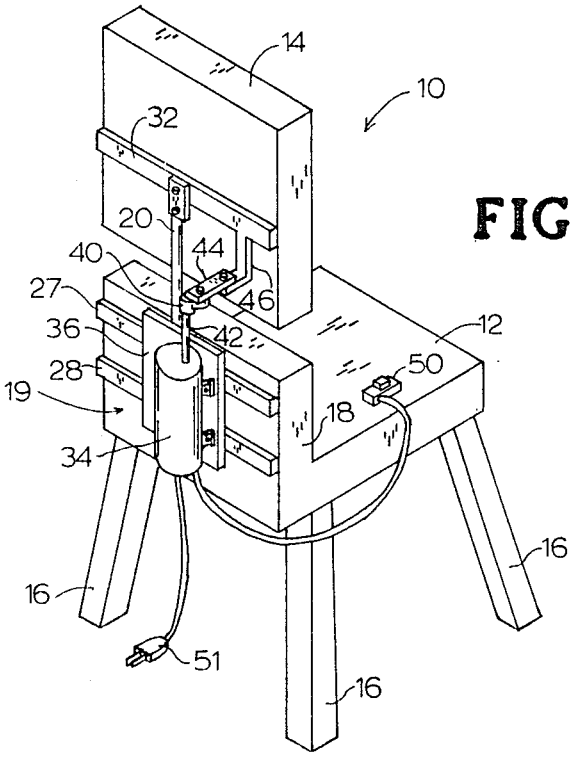
FIG. 1 is a rear perspective view of a first embodiment of the exercise apparatus of the invention.

A first embodiment of the exercise chair of the invention, generally illustrated at 10 in FIGS. 1–5, includes a seat portion 12, a back portion 14 and legs 16. Seat portion 12 includes a lumbar portion 18 which is positioned generally perpendicular to seat portion 12. Legs 16 are secured to seat portion 14 in any conventional manner. A drive assembly 19 oscillates back portion 14 with respect to seat portion 12.

Drive assembly 19 includes a post 20 pivotally connected to lumbar portion 18. As illustrated best in FIG. 5, a first bearing 22 and a second bearing 24 are mounted on a back surface 26 of lumbar portion 18 and receive post 20. Bearings 22, 24 are mounted on braces 27, 28, respectively, which are secured to the back surface 26 of lumbar portion 18 and span the width of the lumbar portion 18. Post 20 is permitted to turn and oscillate with respect to bearings 22,24.

Post 20 is connected to the back surface 14A of back portion 14 by bracket 30 and brace 32. Bracket 30 is fixedly mounted on post 20 by fastener 31. Bracket 30 is fixedly mounted on to brace 32 by fastener 33. It is desirable that brace 32 span the width of back portion 14.

A drive motor 34, e.g. an electric motor, is mounted on plate 36 and includes a switch 50 and an electrical plug outlet 51. Plate 36 is mounted on the back surface 26 of lumbar portion 18 by fasteners 38. Fasteners 38 are threaded and mated to braces 27, 28. Other conventional methods of securing fasteners 38 to braces 27, 28 may be employed. Plate 36 is mounted to be stationary with respect to lumbar portion 18. A cam 40 is mounted on the end of motor shaft 42. Cam 40 is pivotally connected to a first end of lever 44. A second end of lever 44 is pivotally connected to bracket 46. Bracket 46 can be formed integrally with bracket 32 or can be secured to bracket 32 by any conventional means.

Figure 4:
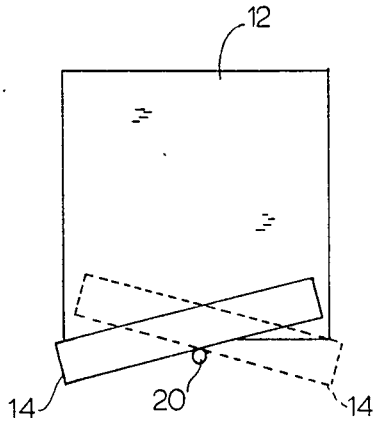
FIG. 4 is a top view of the apparatus of FIG. 1 with the drive assembly deleted for clarity of illustration, showing a first extreme position of the back portion in solid lines and a second extreme position of the back portion in dotted lines.
Figure 5:
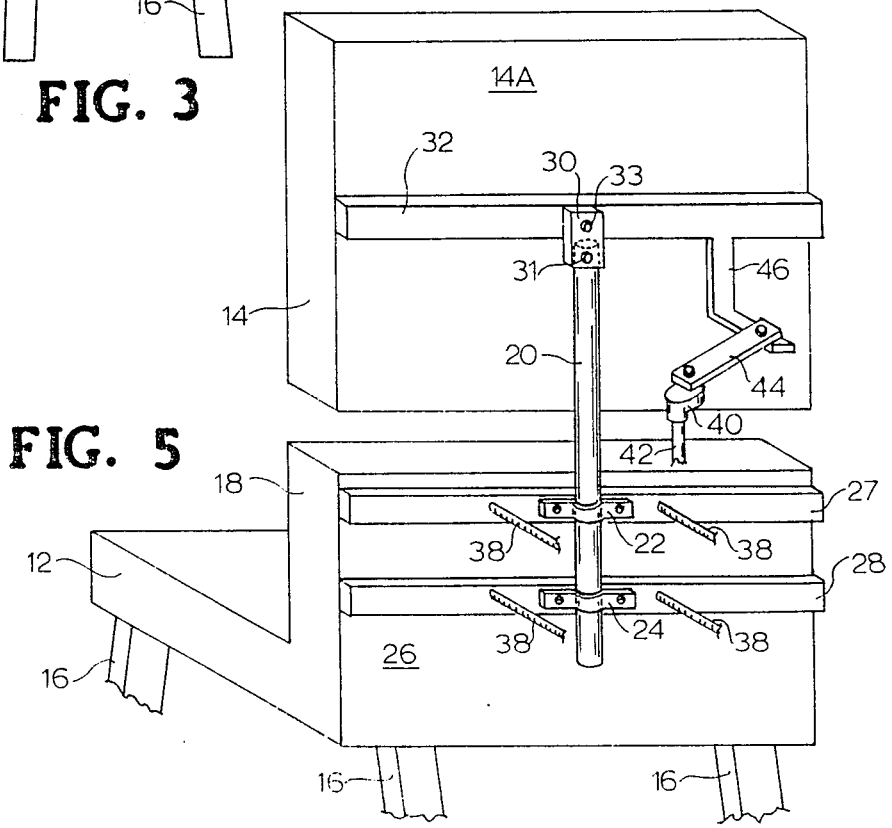
FIG. 5 is an enlarged perspective view of a post and bearings of the apparatus of FIG. 1, wherein the motor has been deleted for purposes of clarity of illustration.

In operation, an operator activates drive assembly 19 with a conventional switch 50. Switch 50 can be mounted at any convenient location on exercise chair 10 or can be provided as a freely-movable wired switch as illustrated in the figures. As the motor shaft 42 rotates, the rotary motion is transferred by cam 40, lever 44 and bracket 46 to the back portion 14. As lever 44 is forced against back portion 14, back portion 14 oscillates about the longitudinal axis of post 20 as illustrated in FIG. 4. As the seat portion 14 oscillates, the shoulders and back of a user are oscillated about the longitudinal axis of post 20. The axis of post 20 is effectively parallel to the central longitudinal axis extending through the back portions.

Figure 2:
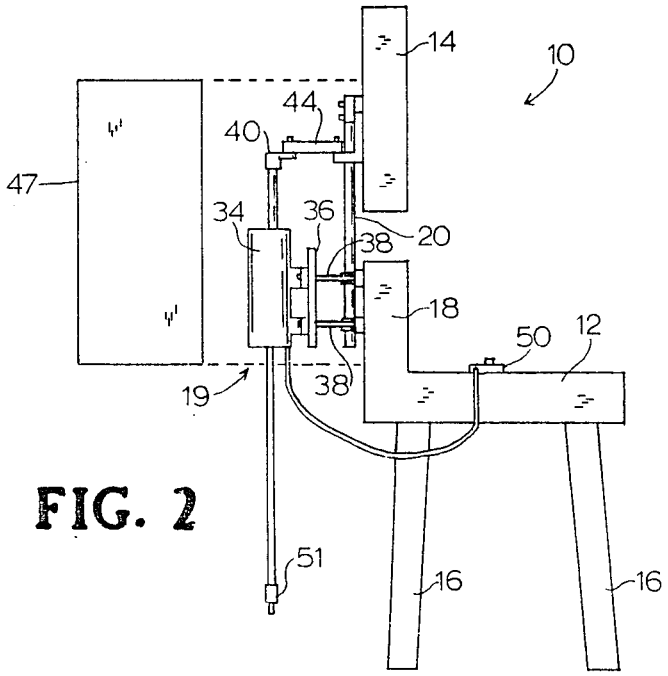
FIG. 2 is a side view of the apparatus of FIG. 1 with a cover removed and illustrated in spaced relation to the remainder of he apparatus to show the drive assembly of the apparatus.
Figure 3:
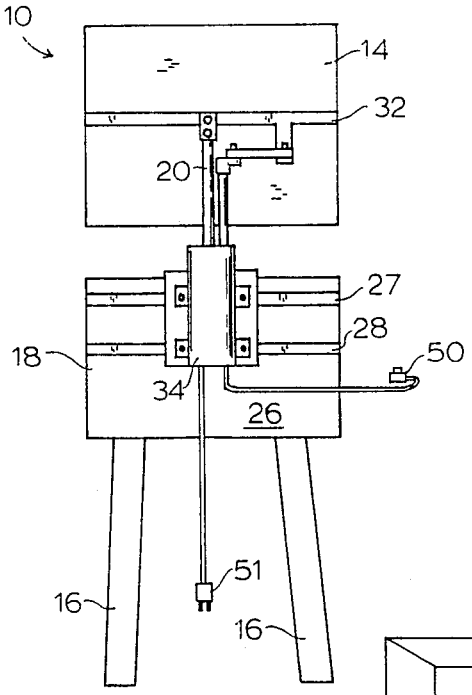
FIG. 3 is a rear view of the apparatus of FIG. 1 with the cover removed.

As illustrated in FIG. 2, it is desirable to include a removable cover 47 on the back portion 14 and the lumbar portion 18 to shield the drive assembly 19. Cover 47 can be removably secured with conventional fasteners (not illustrated).

Figure 6:
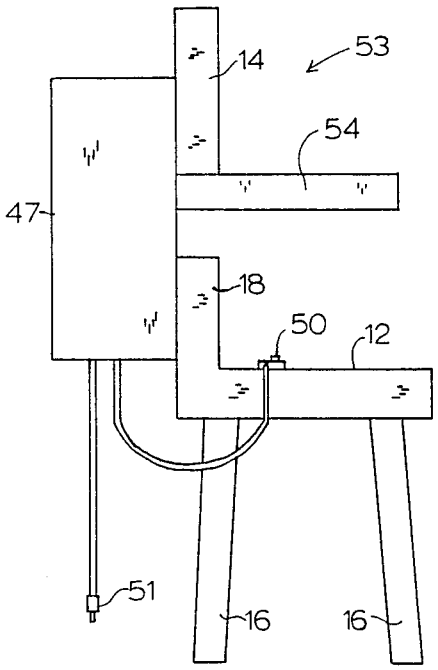
FIG. 6 is a side view of a second embodiment of the invention apparatus illustrating arms secured to the back portion.

As illustrated in FIG. 6, a second embodiment of the exercise chair, indicated generally at 53 and similar to chair 10, includes arms 54 secured on the back portion 14. Arms 54 support the arms of a user and oscillate with the back portion 14. Arms 54 can be secured to back portion 14 in any conventional manner.

Figure 7:
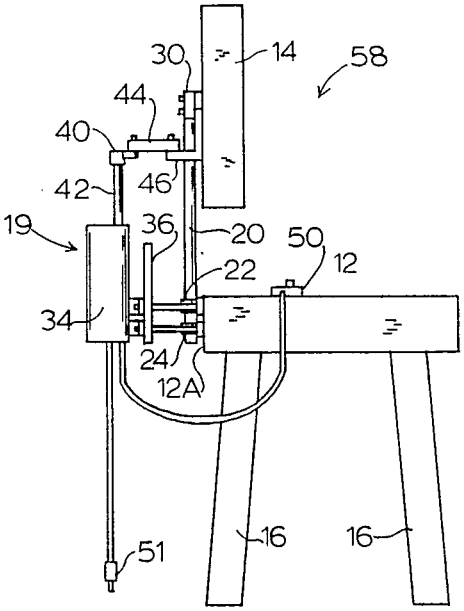
FIG. 7 is a side view of a third embodiment of the invention apparatus wherein a lumbar portion has been eliminated from the apparatus.

A third embodiment of the present exercise chair, indicated generally at 58, is illustrated in FIG. 7. Chair 58 is identical to chair 10 except that the seat portion 12 does not include a lumbar portion 18. Drive assembly 19 is mounted to a back surface 12A of seat portion 12 by bearings 22, 24 which are mounted to back surface 12A and which pivotally support post 20.

Figure 8:
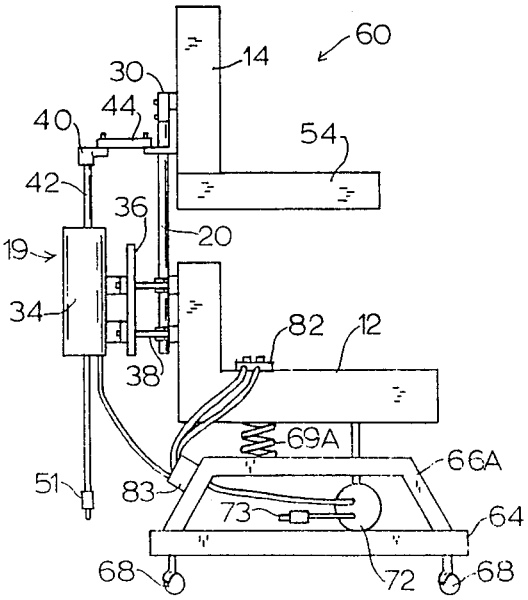
FIG. 8 is a side view of a fourth embodiment of the invention apparatus illustrating a second drive assembly for rocking the apparatus.
Figure 9:
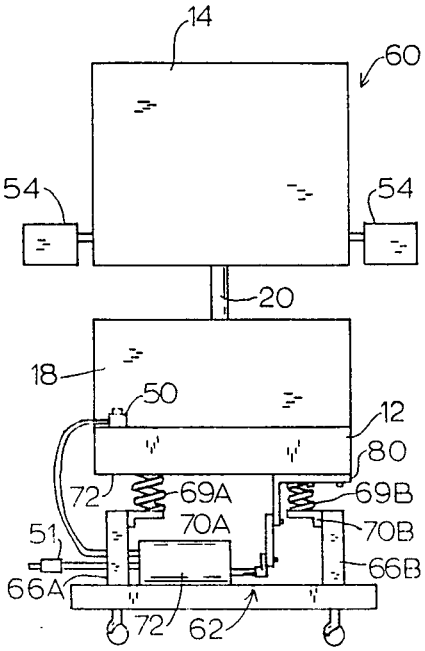
FIG. 9 is a front view of the apparatus of FIG. 8.

A fourth embodiment of the present exercise chair, indicated generally at 60, is illustrated in FIGS. 8 and 9. Drive assembly 19, back portion 14 and seat portion 12 are identical to the corresponding elements described above for exercise chair 10. It is desirable to include arms 54 mounted on back portion 14. Exercise chair 60 includes a second drive assembly 62 which rocks chair 60 independently of the oscillating motion provided by drive assembly 19.

Figure 10:
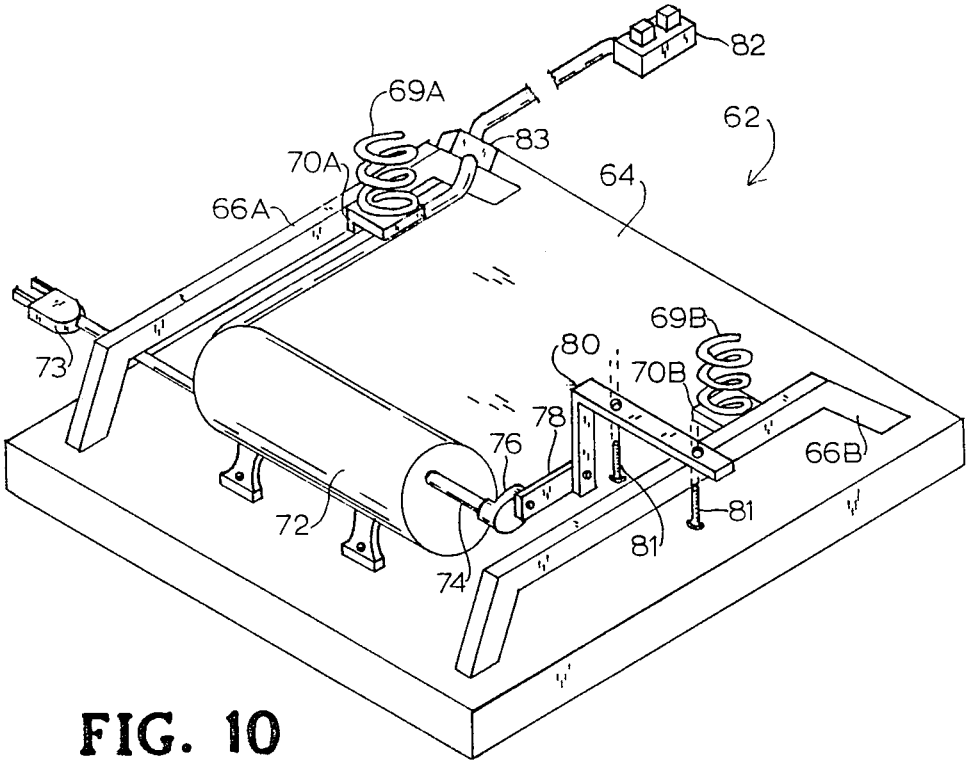
FIG. 10 is an enlarged perspective view of the second drive assembly of the apparatus of FIG. 8.

As illustrated best in FIG. 10, chair 60 includes a platform 64 and base 66A, 66B. If desired, casters 68 or wheels can be mounted on platform 64 for ease of movement of chair 60 (FIGS. 8 & 9). Coil springs 69A, 69B are mounted at a first end on respective brackets 70A, 70B and mounted at a second end to a bottom surface 72 of seat portion 14 by any conventional fasteners (not illustrated).

Drive assembly 62 includes a drive motor 72, e.g. an electric motor having an electrical plug 73, mounted on platform 64. Motor shaft 74 mounts a cam 76 which is pivotally mounted to a first end of a lever 78. The second end of lever 78 is pivotally mounted to a bracket 80 mounted to the bottom surface 72 of seat portion 12 by fasteners 81.

In operation, a user activates drive assembly 62 with a conventional switch 82. Switch 82 can be mounted at any convenient location on chair 60 or can be provided as a freely-movable switch as illustrated in FIGS. 8 and 9. It is preferred that switch 82 be a dual switch and include separate controls for drive assemblies 19 and 62. Guide 83 is mounted on base 66A to guide wires from drive assemblies 19, 62 to switch 82. As the motor shaft 74 rotates, the rotary motion is transferred to the seat portion 14 by cam 76, lever 78 and bracket 80. As the bracket 80 pushes against the seat portion 14, the seat portion 14 rocks back and forth on springs 69A, 69B.

Independently, a user can operate drive assembly 19 to impart an oscillating motion to the back portion 14. Each drive assembly 19 and 62 can be operated independently of one another or can be operated simultaneously. When operated simultaneously, chair 60 provides a rocking motion in seat portion 12 and an oscillating motion for back portion 14.

Figure 11:
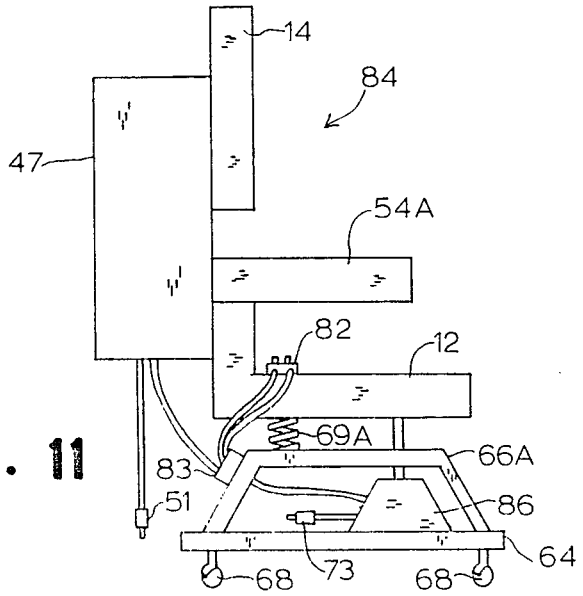
FIG. 11 is a side view of a fifth embodiment of the invention apparatus illustrating arms secured on the lumbar portion of the seat portion.

A fifth embodiment of the exercise apparatus, indicated generally at 84, is illustrated in FIG. 11. Chair 84 is identical to chair 60 except that arms 54A are secured to the lumbar portion 18 of seat portion 12 instead of to the back portion 14. Arms 54A rock with seat portion 12 when drive assembly 62 is activated.

It is desirable that a removable cover 86 by provided to shield drive assembly 62. Cover 86 can be fitted between bases 66A, 66B and beneath seat portion 12. Cover 86 can be removably secured with conventional fasteners (not illustrated).

Figure 12:
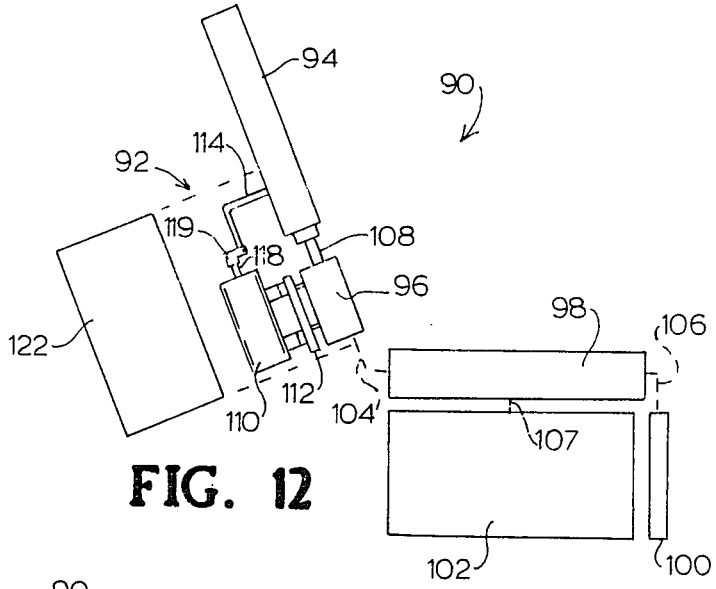
FIG. 12 is a schematic side view of a sixth embodiment of the invention apparatus incorporated into a conventional recliner illustrated in an upright position and with the conventional linkages and brackets schematically illustrated.
Figure 13:
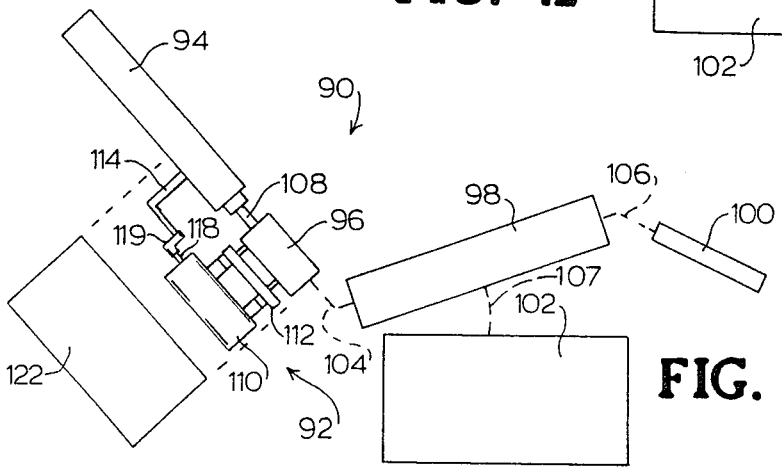
FIG. 13 is a schematic side view of the apparatus of FIG. 12 wherein the recliner is illustrated in an extended position and with the conventional linkages and brackets schematically illustrated.
Figure 14:
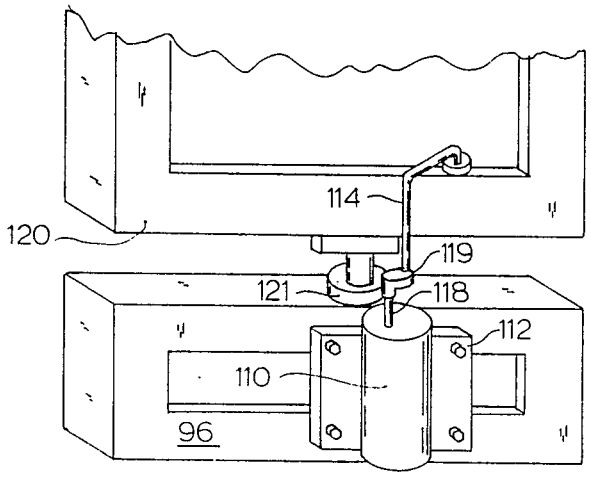
FIG. 14 is a perspective view of the drive assembly mounted on the apparatus of FIGS. 12 and 13.

A sixth embodiment of the exercise chair, indicated generally at 90, is illustrated schematically in FIGS. 12 and 13. A drive assembly 92 is incorporated in a conventional reclining chair 90 to oscillate an upper back portion 94 of chair 90.

Reclining chair 90 includes an upper back portion 94, a lower back portion 96, a seat portion 98, a footrest 100 and a base portion 102. Conventional brackets and linkages and bracket-linkage assemblies (not shown and schematically indicated) connect the various components of recliner 90 in a well-known manner. The upper and lower back portions 94, 96, seat portion 98 and foot rest 100 move in correspondence with each other and in unison when moving between upright and reclined positions.

In the views of FIGS. 12 and 13, a bracket-linkage assembly 104, indicated schematically by dashed lines, supports and pivotally connects lower back portion 96 to seat portion 98. A bracket-linkage assembly 106, indicated schematically by dashed lines, pivotally connects seat portion 98 with footrest 100 and a bracket-linkage assembly 107, indicated schematically by dashed lines, connects seat portion 98 with base portion 102. In FIG. 12, recliner 90 is illustrated in a first or upright position. In FIG. 13, recliner 90 is illustrated in a second or reclining position. The components of recliner 90 are supported by base portion 102 in a well-known manner. Base portion 102 remains stationary in both the upright and extended positions of recliner 90. As previously mentioned, upper back portion 94 and lower back portion 96 tilt together in unison between reclining and upright positions.

A post 108 is fixedly connected at a first end to upper back portion 94 and is pivotally connected at a second end to lower back portion 96 at bearing 121. Post 108 permits upper back portion 94 to swivel or oscillate with respect to lower back portion 96. Drive assembly 92 includes an electric drive motor 110 mounted on a plate 112. Linkage 114 is fixedly connected at a first end to motor shaft 118 through cam 40. At a second end, linkage 114 is pivotally connected to brace 120. Brace 120 is fixedly connected to shaft 108. A removable cover 122 is conventionally mounted to upper and lower back portions 94 and 96 to shield drive assembly 92.

In operation, drive motor 110 drives linkage 114 to cause upper back portion 94 to oscillate about the longitudinal axis of shaft 108. This oscillating movement can be achieved when recliner 90 is in the upright position of FIG. 12 or in the extended position of FIG. 13. It will be understood that a conventional switch can be used to selectively activate drive assembly 92.

Although the present invention has been described with reference to preferred embodiments, persons skilled in the art will recognize that changes may be made in form and detail without departing from the spirit and scope of the invention. For example, it is within the scope of the invention to incorporate a second drive assembly with recliner 90 to provide a rocking motion to base portion 102. In this manner, a user can receive an oscillating motion to the upper torso when the recliner 90 is extended or upright, while base portion 102 simultaneously rocks in a manner similar to chair 60.

What is claimed is:

1. A reclining chair having means for tilting and reclining, seat back and footrest members thereof enabling such members to be positionable between upright and reclining positions, comprising:

(a) an upper back portion for supporting the upper torso of a user;

(b) a lower back portion for supporting the lumbar portion of a user, the upper back portion being connected to the lower back portion to oscillate with respect to the lower back portion about an axis parallel to the central longitudinal axis of said upper back portion and to tilt in unison with the lower back portion between upright and reclining positions utilizing the tilting and reclining means of the chair;

(c) a seat portion for supporting the lower body of a user, the seat portion connected to the lower back portion in a manner such that the lower back portion, utilizing the tilting and reclining means of the chair, tilts in correspondence with tilting of the seat portion; and (d) drive means, mounted on a selected rearwardly disposed portion of the chair for oscillating the upper back portion with respect to the lower back portion about said axis.

2. A reclining chair as claimed in claim 1 including a post connected at a first end to the upper back portion and at a second end to the lower back portion in a manner to permit the upper back portion to oscillate about the post longitudinal axis.

3. A reclining chair as claimed in claim 1 wherein the drive means comprises:

(a) motor means mounted on the lower back portion; and (b) linkage means fixedly connected between the motor means and upper back portion and operative to oscillate said upper back portion with respect to said lower back portion about said axis.

4. A reclining chair as claimed in claim 1 including a footrest connected to and tiltable in correspondence with tilting of the seat portion.

5. A reclining chair as claimed in claim 2 wherein said post is fixedly connected at said first end to said upper back portion and is pivotedly connected at said second end to said lower back portion.

6. A reclining chair as claimed in claim 3 wherein said motor means is mounted on said lower back portion.

* * * * *

UNITED STATES PATENT AND TRADEMARK OFFICE

CERTIFICATE OF CORRECTION

PATENT NO. : 4,860,733

DATED : August 29, 1989

INVENTOR(S) : Alonzo E. Parker

It is certified that error appears in the above-identified patent and that said Letters Patent is hereby corrected as shown below:

Column 2, line 31, correct "he" to read --the--.

Column 6, line 5, delete the comma and correct "seat back" to read --back seat--.

Column 6, line 25, delete the comma.

Signed and Sealed this

Seventh Day of August, 1990

*Attest:*

HARRY F. MANBECK, JR.

*Attesting Officer*

*Commissioner of Patents and Trademarks*